US012044117B2

(12) United States Patent
Keller et al.

(10) Patent No.: US 12,044,117 B2
(45) Date of Patent: Jul. 23, 2024

(54) METHODS FOR ESTIMATING DOWNHOLE WEIGHT ON BIT AND RATE OF PENETRATION USING ACCELERATION MEASUREMENTS

(71) Applicants: Halliburton Energy Services, Inc., Houston, TX (US); Board of Regents, The University of Texas System, Austin, TX (US)

(72) Inventors: Alexander Mathew Keller, Austin, TX (US); Ketan C. Bhaidasna, Houston, TX (US); Jian Wu, Houston, TX (US); Robert P. Darbe, Houston, TX (US); Julien Christian Marck, Houston, TX (US); Nazli Demirer, Houston, TX (US); Umut Zalluhoglu, Houston, TX (US); Tianheng Feng, Austin, TX (US); Dongmei Chen, Austin, TX (US)

(73) Assignees: Halliburton Energy Services, Inc., Houston, TX (US); Board of Regents, The University of Texas System, Austin, TX (US)

( * ) Notice: Subject to any disclaimer, the term of this patent is extended or adjusted under 35 U.S.C. 154(b) by 103 days.

(21) Appl. No.: 17/685,848

(22) Filed: Mar. 3, 2022

(65) Prior Publication Data

US 2023/0279767 A1 Sep. 7, 2023

(51) Int. Cl.
*E21B 45/00* (2006.01)
*E21B 47/024* (2006.01)

(52) U.S. Cl.
CPC ..... *E21B 45/00* (2013.01); *E21B 47/024* (2013.01)

(58) Field of Classification Search
CPC ..... E21B 45/00; E21B 47/024
See application file for complete search history.

(56) References Cited

U.S. PATENT DOCUMENTS

| | | | | |
|---|---|---|---|---|
| 5,864,058 | A * | 1/1999 | Chen | E21B 47/00 73/152.47 |
| 7,058,512 | B2 | 6/2006 | Downton | |
| 8,180,614 | B2 | 5/2012 | Pabon et al. | |
| 8,977,523 | B2 | 3/2015 | Ertas et al. | |
| 9,285,794 | B2 | 3/2016 | Wang et al. | |
| 9,970,266 | B2 | 5/2018 | Marx et al. | |
| 10,900,342 | B2 | 1/2021 | Belaskie et al. | |
| 10,907,464 | B2 | 2/2021 | Zha et al. | |

(Continued)

FOREIGN PATENT DOCUMENTS

EP 0626032 B1 12/1995

OTHER PUBLICATIONS

Hegde, Chiranth, et al. "Analysis of rate of penetration (ROP) prediction in drilling using physics-based and data-driven models." Journal of petroleum science and Engineering 159 (2017): 295-306.

(Continued)

*Primary Examiner* — Dany E Akakpo

(57) ABSTRACT

Methods and compositions for estimating one or more downhole qualities of a drilling apparatus by obtaining axial acceleration data. The axial acceleration data may be acquired by measuring an axial acceleration of a bottom hole assembly. The axial acceleration may then be used to estimate one or more of a downward weight on a drill bit of the drilling apparatus or a rate of penetration of the drill bit.

16 Claims, 4 Drawing Sheets

(56) References Cited

U.S. PATENT DOCUMENTS

| | | | | |
|---|---|---|---|---|
| 2002/0195276 | A1 | 12/2002 | Dubinsky et al. | |
| 2018/0025269 | A1 | 1/2018 | Dursun et al. | |
| 2019/0265381 | A1* | 8/2019 | Sugiura | G01V 3/18 |
| 2019/0345811 | A1 | 11/2019 | Orban | |
| 2020/0326226 | A1* | 10/2020 | Camacho Cardenas | E21B 19/00 |
| 2023/0266500 | A1* | 8/2023 | Soroush | E21B 41/00 175/50 |

OTHER PUBLICATIONS

Lei, Lingyun. Downhole Weight on Bit Prediction with Analytical Model and Finite Element Method. MS thesis. Graduate Studies, 2014.

* cited by examiner

METHODS FOR ESTIMATING DOWNHOLE WEIGHT ON BIT AND RATE OF PENETRATION USING ACCELERATION MEASUREMENTS

GOVERNMENT LICENSE RIGHTS

This invention was made with government support under Grant no. CMMI2041470 awarded by the National Science Foundation. The government has certain rights in the invention.

BACKGROUND

The present disclosure relates to estimating the downhole weight on bit and rate of penetration of a drilling apparatus's bottom hole assembly.

Acquisition of real-time weight on bit ("WOB") measurements is important for several aspects of the drilling process. For example, WOB is controlled by the driller to (1) vary the build and turn rates of directional tools; (2) manipulate the rate of penetration ("ROP") of a drill bit; and (3) prevent tool damage. However, WOB measurement has two fundamental limitations. First, due to complex loads that act on the drill string, WOB measurement is a mere proxy of the actual weight on bit, referred to as the downhole weight on bit ("DWOB"). Second, WOB is acquired on the surface and must be downlinked for use on downhole tools, a process which consumes the limited communication bandwidth between the surface and downhole. In the context of downhole directional control of rotary steerable systems, the low-frequency feedback associated with downlinking WOB data is especially problematic, as it degrades the user's ability to directionally control the system. Though direct measurement of the axial force along the bottom hole assembly ("BHA") can address these issues, direct measurement can be cost-prohibitive and is sometimes limited to post-job analysis.

ROP information is necessary to determine the location of the bit while drilling and to autonomously control the drilling trajectory along an arbitrary well plan. However, like WOB, ROP measurement is traditionally acquired on the surface; thus, ROP measurement suffers from the same accuracy and feedback frequency issues as WOB measurement. Accordingly, downhole directional control of rotary steerable systems is limited using existing surface-based ROP measurement methods. In the context of autonomous downhole control, it is impossible to measure position without real-time information of ROP available downhole.

BRIEF DESCRIPTION OF THE DRAWINGS

These drawings illustrate certain aspects of some of the embodiments of the present disclosure, and should not be used to limit or define the claims.

Figure 1A:
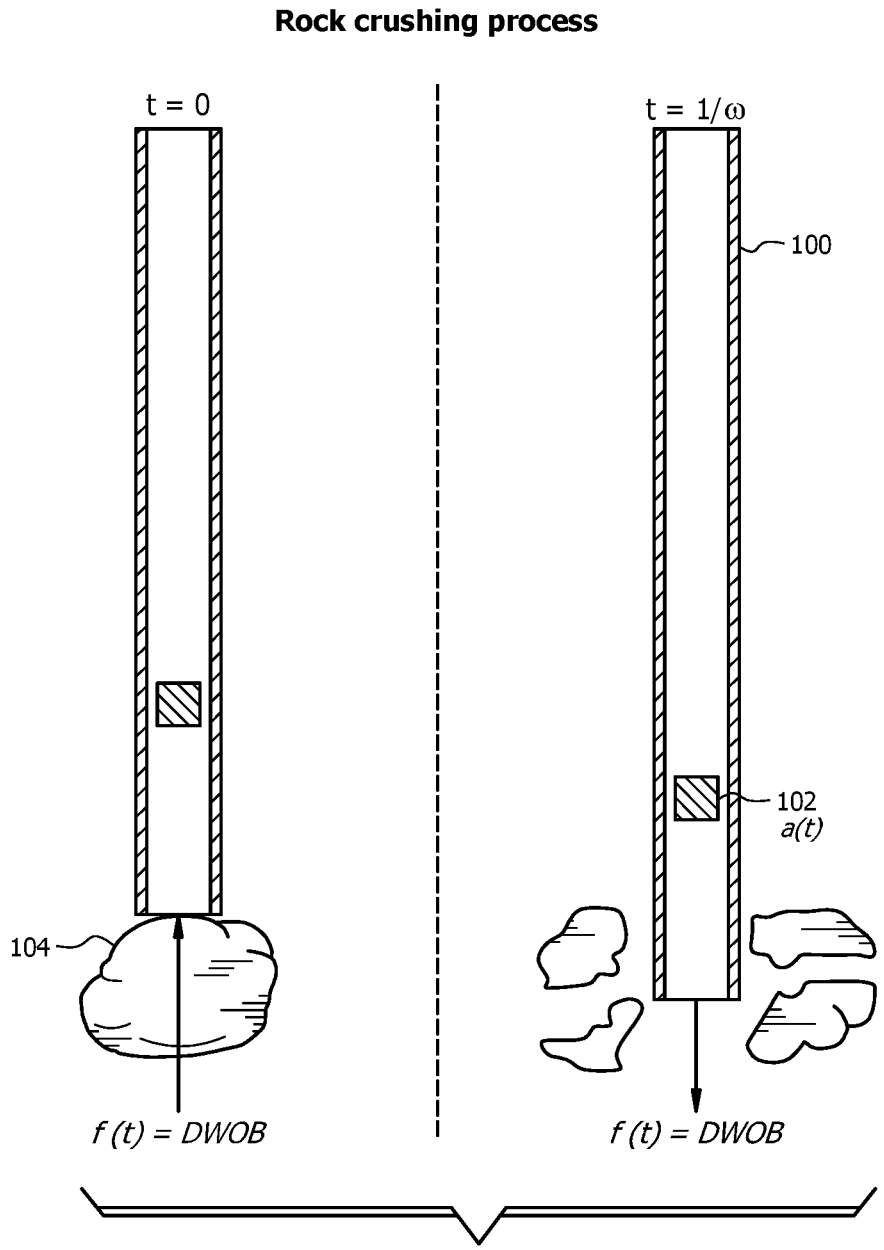
FIG. 1A is a diagram illustrating an example of a drilling process modeled as a rock crushing treatment that may be used in accordance with certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

The present disclosure relates to estimating the downhole weight on bit and rate of penetration of a drilling apparatus's bottom hole assembly. More particularly, the present disclosure relates to methods and compositions for using axial acceleration data to estimate one or more of DWOB and downhole ROP for improved downhole directional control of rotary steerable systems and mud motors, both onshore and offshore.

The proposed methodology produces estimates of DWOB and ROP using measurements of axial acceleration. A plurality of downhole sensors on the BHA is used to gather input data. In certain embodiments, DWOB estimates may be determined using a forced mass-spring-damper model of the drill string excited by a force proportional to the DWOB. The steady state peak acceleration of this system may be solved for analytically and may provide an equation relating DWOB and peak axial acceleration. DWOB may be estimated with measurements of peak axial acceleration and properties of the BHA and drill pipe. Estimates may be produced in real-time, limited only by the sampling rate of acceleration. In certain embodiments, ROP estimates may be determined using a data-driven model, which may take as inputs measurements from sensors, indices, or functions thereof. In one or more embodiments, the ROP model may be composed of two sub models. In certain embodiments, the first ROP model may be a k-means model, which may partition the data into k clusters. In one or more embodiments, the second ROP model may be a data-driven regression model, which may produce an estimate of ROP as a function of the model's inputs. The ROP model may be retrained at regular intervals of distance or time using recent measurements of ROP that are downlinked from the surface. Retraining allows the ROP model to remain accurate despite changing drilling conditions. All DWOB and ROP methods disclosed herein apply to onshore and offshore rotary steerable devices. In addition, the DWOB methods apply to onshore and offshore mud motors.

Among the many potential advantages to the methods and compositions of the present disclosure, only some of which are alluded to herein, the methods and compositions of the present disclosure can increase the frequency of data received by downhole directional drilling systems. Furthermore, the methods and compositions of the present disclosure can improve the accuracy of DWOB and ROP data using easily available inputs such as BHA vibration, BHA axial acceleration, and drill bit rotational velocity. Moreover, the methods and compositions disclosed herein can help reduce the bandwidth load allocated to DWOB and ROP measurement. Through increased data frequency, increased accuracy, and decreased bandwidth requirements, the above improvements allow for cost-efficient improved directional control of downhole drilling systems One or more embodiments of the present disclosure collects data from sensors disposed upon a BHA. In certain embodiments, the BHA may comprise one or more of drill collars, subs, reamers, shocks, hole openers, or sensors. In certain embodiments, the BHA may further comprise one or more of the bottom of the drill string, a bit sub, and a bit. In certain embodiments, the BHA may connect to the drill pipe. Directional control of the BHA may be imposed via one or more of a rotary steerable system or a mud motor. In certain embodiments, data may be collected by one or more sensors disposed upon the BHA, sent to an information handling unit, and used to estimate DWOB and/or downhole ROP to improve directional control of the BHA. In certain embodiments, the BHA may be controlled by a user on the surface. In certain embodiments, the BHA may be controlled automatically by one or more downhole systems or surface systems.

One or more sensors may be disposed upon the BHA. The one or more sensors may be one or more of measurement while drilling ("MWD") sensors, logging while drilling ("LWD") sensors, accelerometers, gyroscopes, magnetometers, imagers, calipers, or other sensors. The one or more sensors may measure and/or provide inputs to the information handling system to estimate one or more attributes of the BHA, the wellbore, and/or the surrounding formation. For example and without limitation, these attributes may include BHA acceleration (for example and without limitation axial acceleration), drill bit rotational velocity, drill bit position, drill bit azimuth, drill bit inclination, flow rate, one or more formation indicators (for example and without limitation, one or more of formation resistivity, density, porosity, and gamma ray data), BHA mass, drill pipe system mass, drill pipe length, the speed of sound in the drill pipe, or the BHA stick-slip-index. In certain embodiments, one or more of single source sensors or pairs of sensors may be used to measure and/or provide inputs to the information handling system. In certain embodiments, one or more sensors may be in electronic communication with an information processing system. In certain embodiments, data from one or more sensors may be transmitted to an information handling system in real time, for example and without limitation by one or more of mud pulse telemetry or wired pipe technology.

A drill bit may be disposed upon the BHA. The drill bit may be one or more of a Polycrystalline Diamond Compact ("PDC") bit, roller cone bit, natural diamond bit, or other kind of drill bit. In certain embodiments, one or more of the direction or the speed of the drill bit may be controlled by a user on the surface. In certain embodiments, one or more of the direction or the speed of the drill bit may be controlled automatically by one or more downhole systems or surface systems.

FIG. 1A is a diagram illustrating an example of a drilling process modeled as a rock crushing treatment that may be used in accordance with certain embodiments of the present disclosure. In this nonlimiting example, the drill string 100 connects to the BHA, which drills into the formation 104. In certain embodiments, an accelerometer 102 may be disposed upon the BHA to gather acceleration data. In certain embodiments, the drilled formation may be modeled as a rock 104 being crushed repeatedly by the BHA. Throughout the drilling process, the drill string 100 may be repeatedly compressed and elongated. At any given time, t, the BHA and its accelerometer 102 may accelerate at an acceleration of a(t). FIG. 1A depicts the compression and elongation of the drill string 100 and the subsequent translation of the accelerometer at two instances in time. Through a model like the one depicted in FIG. 1A, the axial force on the bit may be modeled as a sinusoid with amplitude equal to the DWOB and frequency equal to the stick slip frequency. FIG. 1A depicts one non-limiting model used in certain aspects of the present disclosure; one or more models may be used without departing from the scope of the present disclosure, including and without limitation the models explicitly discussed herein.

Figure 1B:
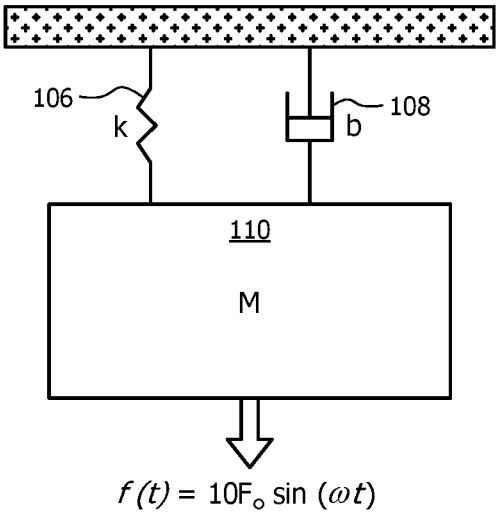
FIG. 1B is a diagram illustrating an example of a lumped parameter model of a drilling process that may be used in accordance with certain embodiments of the present disclosure.

FIG. 1B is a diagram illustrating an example of a lumped parameter model of a drilling process that may be used in accordance with certain embodiments of the present disclosure. In certain embodiments, the BHA and heavy walled rill pipe may be approximated as lumped, rigid bodies, and the drill pipe may be approximated as a spring with an evenly distributed mass. Accordingly, the combined mass of the BHA/drill pipe system 110, M, may be modeled as if it were suspended by a spring with a spring constant 106, k, and a damping constant 108, b. One such model is mathematically described in more detail below, according to one or more embodiments of the present disclosure.

The total mass of the system may be determined with the equation below:

$$M = m_{bha} + \frac{1}{3} m_{drillpipe}$$

Here, $m_{bha}$ is the total mass of the BHA (including the mass of heavy walled drill pipe), and $m_{drillpipe}$ is the total mass of the drill pipe in the borehole (excluding the mass of the heavy walled drill pipe). The constant factor of ⅓ is derived using conservation of momentum of an ideal spring with an evenly distributed mass. The spring constant 106 may be determined by:

$$k = \frac{EA}{L}$$

Here, k is the spring constant 106, E is the modulus of elasticity of the drill pipe material, A is the cross-sectional area of the drill pipe, and L is the cumulative length of the drill pipe. The damping constant 108, b, may be characterized by the damping ratio ζ:

$$\zeta = \frac{b}{2\sqrt{(kM)}} \approx 0.3$$

Here, the value 0.3 has been determined empirically to produce satisfactory results across several sets of data. In one or more embodiments of the present disclosure, a value in the range of 0.1 to 0.5 may be used for ζ. In certain embodiments, ζ may be estimated using the equation above. Mass may be calculated using a sinusoidal forcing function:

$$f(t)=\alpha F_o \sin(\omega t)$$

Here, $F_o$ is the downhole weight on bit (DWOB) and a is an empirical scaling factor roughly equal to 9.81, the magnitude of acceleration due to gravity. The frequency ω may be approximated with a model of the stick slip frequency $\omega_{ss}$:

$$\omega = \omega_{ss} \cong a\frac{2\pi}{4L}\sqrt{\frac{G}{\rho}} + b$$

Here, G is the shear modulus of elasticity of the drill pipe material, p is the density of the drill pipe material, L is the length of the drill string, and a and b are tuning parameters that can be calibrated using data fitting techniques. In one or more embodiments, a may be estimated to be 1. In one or more embodiments, b may be estimated to be 0. The translation of the accelerometer located on the BHA may be described by the ordinary differential equation ("ODE"):

$$x'' + 2w_n\zeta x' + w_n^2 x = \frac{\alpha w_n^2}{k}F_o\sin(wt)$$

Here, $w_n$ is the natural frequency of the system according to the equation:

$$w_n = \sqrt{\frac{k}{M}}$$

Solving the ODE for the steady state acceleration of the mass results in the following equations relating acceleration of the mass a(t) and the downhole weight on bit $F_o$, $$a(t) = -A_o\sin(\omega t * \phi)$$

$$A_o = \frac{\alpha F_o \omega^2}{k\left[\left(1 - \frac{\omega^2}{w_n^2}\right)^2 + \left(\frac{2\zeta\omega}{w_n}\right)^2\right]^{\frac{1}{2}}}$$

Here, $A_o$ is the peak acceleration of the mass; through the rigid body assumption, $A_o$ represents the accelerometer located on the BHA. In one or more embodiments, the peak acceleration may be calculated as the max absolute value of acceleration measurements over a window of time not less than the period of axial vibrations. In certain embodiments, one or more filters (either analog or digital) may be implemented to remove noise from the raw accelerometer readings before peak axial acceleration is determined. Solving for DWOB ($F_o$) results in the linear equation:

$$F_o = A_o k\frac{\left[\left(1 - \frac{\omega^2}{\omega_n^2}\right)^2 + \left(\frac{2\zeta\omega}{\omega_n}\right)^2\right]^{\frac{1}{2}}}{\alpha\omega^2}$$

In certain embodiments, the above model may be used to determine DWOB as a function of peak axial acceleration of the BHA. In certain embodiments, the terms in the above model may be recomputed at each instant that a new peak acceleration measurement $A_o$ is acquired to determine an estimate of downhole weight on bit $F_o$.

The above DWOB model is based on a lumped parameter model; however, those skilled in the art and with the benefit of this disclosure will understand that any suitable model may be used without departing from the scope of the present disclosure (for example and without limitation, a higher order lumped mass model or finite element model could be used). Further, the method could be extended to include non-analytical models. One non-limiting example of a non-analytical model is a machine learning model (for example and without limitation, one or more of a neural-network based model, a tree-based regression model, or a support vector machine). In certain embodiments, this methodology may be applied to estimating surface weight on bit using vibration data for the purpose of high frequency access to surface weight on bit for applications onboard downhole tools. In certain embodiments, coefficients of the model may be determined with data through one or more of an appropriate fitting method, parameter identification method, or optimization method. This process may take place in real-time or by using historical drilling data. The method disclosed above uses only measurements of axial acceleration; however, other data acquired downhole could be used to improve the model. In certain embodiments, examples of other data that could be used to improve the model include one or more of lateral acceleration, vibration, rotary velocity, indicators of lithological properties, or one or more other parameters. In certain embodiments, axial acceleration may be indirectly measured using vibration data. In certain embodiments, the excitation frequency of axial vibrations may be used to estimate the frequency of stick slip vibrations.

In addition to methods for estimating DWOB, the present disclosure describes methods for estimating downhole ROP. In certain embodiments, the ROP estimation process may begin by acquiring a sequence of n ROP measurements over a length of time T at a predefined sampling rate $f$, such that:

$$n = Tf \qquad \text{(Equation 1)}$$

The sequence of n ROP measurements may be acquired through any available methods (for example and without limitation, by differentiating the angle measurement of an encoder on the shaft of the draw works). In certain embodiments, the sequence of n ROP measurements may be acquired from the surface. In one or more embodiments, the ROP measurements may then be filtered to remove any corrupted measurements and paired with an associated timestamp marking the beginning of the sequence. In one or more embodiments, a suitable compression technique may be used to reduce the size of the data while losing minimal information. There are many methods of data compression available to one skilled in the art and with the benefit of this disclosure, including and without limitation by fitting a polynomial to the data with fewer coefficients than data points. The data sequence and timestamp may be downlinked to a computerized module downhole which may receive and decompress the data as needed.

In certain embodiments, a plurality of downhole sensors disposed upon the BHA may measure one or more data parameters, including and without limitation BHA acceleration (for example and without limitation axial acceleration), drill bit rotational velocity, drill bit position, drill bit azimuth, drill bit inclination, flow rate, one or more formation indicators (for example and without limitation, one or more of formation resistivity, density, porosity, and gamma ray data), BHA mass, drill pipe system mass, drill pipe length, the speed of sound in the drill pipe, or the BHA stick-slip-index. The measurements may be filtered and/or downsampled to match the sampling rate $f$ Additional indices or functions of the measurements that may be useful as inputs to the model, such as the stick-slip-index, may be calculated and then stored as the feature set $V_j=\{v_{j+1}, \ldots, v_{j+n}\}$, where $v_i$ is a vector of input features (measurements, indices, or functions thereof) and j is the number of features previously computed. In certain embodiments, the computerized module may pair the downhole measurements with an associated ROP sample, producing a set of pairs $M_j=\{\{v_{j+1}, s_{j+1}\}, \ldots, \{v_{j+n}, s_{j+n}\}\}$, where $v_i$ is the vector of downhole measurements and $s_i$ is the ROP sample that was acquired at approximately the same time. $M_j$ represents the most recent samples of input-output data necessary to train a data-driven model. In certain embodiments, this process may be repeated at regular intervals of distance or time. Any distance or time interval may be used without departing from the scope of the present disclosure. In one or more embodiments, the resulting pairs may be appended to the previous pairs, increasing the size of the training set $M=\{M_1, \ldots, M_N\}$ and feature set $V=\{V_1, \ldots, V_N\}$ as drilling progresses.

In certain embodiments, the module may train a data-driven model after pairing is complete. In certain embodiments, the data-driven model may map the features $v_i$ to an estimate of ROP. In certain embodiments, the model may be composed of two sub-models. In one non-limiting example of a model with two sub models, the output of the first model may be used as an input to the second model. One such model with two sub-models is disclosed below, but it is within the ability of those skilled in the art and having the benefit of this disclosure to choose a suitable model for a given application.

The first sub-model may be an unsupervised clustering model. In certain embodiments, the unsupervised clustering model may be a k-means model. This model may produce subsets of the training data according to the similarity of the features. The second sub-model may be a supervised data-driven regression model. In certain embodiments, the data-driven regression model may be a Random Forest model. In one or more embodiments, a Random Forest model may be trained on the individual subsets of training data, resulting in multiple regression models. The k-means model may partition the input data into $k \leq N$ sets $S^*=\{S_1^*, \ldots, S_k^*\}$ by minimizing the within-cluster sum of squares according to Equation 2:

$$S^* = \underset{S}{\operatorname{argmin}} \sum_{i=1}^{k} |wS_j| \operatorname{Var}(wS_j) \quad \text{(Equation 2)}$$

Here, $\mu_j$ is the mean of the data in $S_j$, and w is a feature-specific weight vector. In certain embodiments, the number of sets k may be chosen based on one or more of the well, the formation, and the field. In certain embodiments, k may be increased. For example and without limitation, k may be increased when drilling through many different strata. Similarly, k may be increased when significant variation in the environment exists that may influence the drill bit's ROP. In certain embodiments, k may be chosen according to equation 3. The intuition behind Equation 3 is that greater quantities of data indicate a further distance drilled, and further distances drilled indicate a greater likelihood that the environment has changed significantly, thereby altering the ROP response.

$$k = \mathit{floor}(3\sqrt{N/100}) \quad \text{(Equation 3)}$$

Here, *floor* is the floor function (that is, a function outputting the largest integer less than or equal to the input). In one or more embodiments, the inputs to the k-means model may be normalized. In one or more embodiments, the inputs to the k-means model may be normalized to have a mean of zero and a variance of 1. One or more inputs may be prescribed equal or different weights to influence the clustering results. In one non-limiting example, the axial acceleration may be weighted three times as heavily as the other inputs. In certain embodiments, optimal weights may be chosen empirically.

The clustering process may provide additional information about the state of the system that may not be available in the downhole measurements. In certain embodiments, clustering may be performed on an augmented feature vector $V'=\{v_1', \ldots, v_n'\}$ by including an additional input i, which indicates the feature's index such that $v_i'=\{v_i, i\}$. By including the monotonically increasing feature i, clustering balances similar drilling conditions with the distance from training samples. In certain embodiments, the model may discriminate the data according to when it was acquired, thereby creating a preference for models trained with more recent data. In certain embodiments, the model may automatically select a model trained on data that resembles the current drilling conditions, even if the selected model's training data is not the most recent training data. In certain embodiments, the model may strike a balance between (1) the recency of training data; and (2) the degree of similarity between current drilling conditions and drilling conditions present when the training data was gathered.

Figure 2:
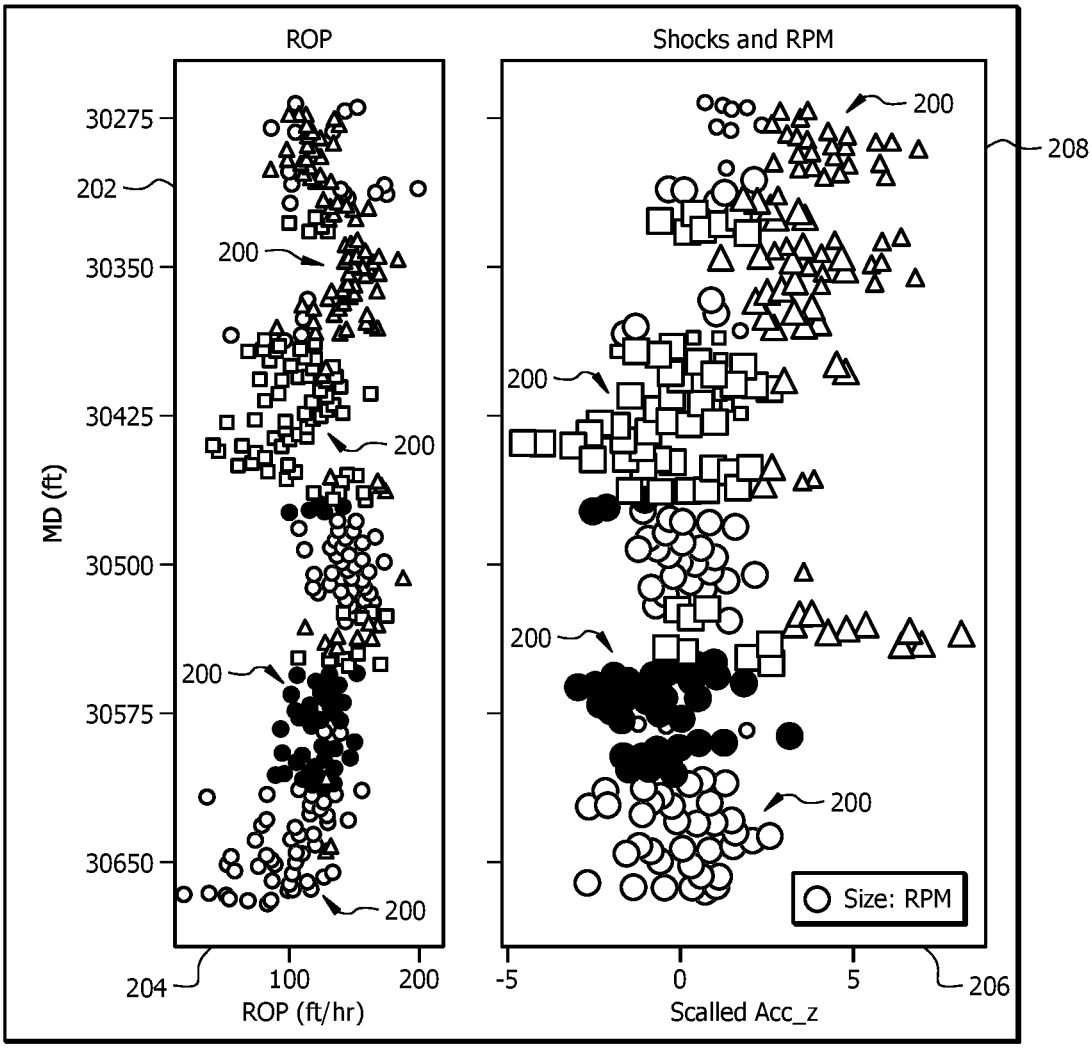
FIG. 2 is a diagram illustrating an example of clustering results of a downhole ROP model that may be used in accordance with certain embodiments of the present disclosure.

FIG. 2 is a diagram illustrating an example of clustering results of a downhole ROP model that may be used in accordance with certain embodiments of the present disclosure. In certain embodiments, the model may utilize three dimensions. For example and without limitation, FIG. 2 clusters data 200 on three axes: (1) measured depth ("MD") 202; (2) axial acceleration ("Acc_z") 206; and (3) rotational velocity ("RPM") 208. The clustering model may be used to find correlations between the data's ROP measurement 204 across the model's dimensions.

In certain embodiments, the clustered data may be used to train k Random Forest models. In certain embodiments, the k value may be equal to the number of data clusters. Random Forest models may be suitable because (1) they are robust to outliers in the training data; (2) they can approximate non-linear and discontinuous functions; and (3) they can produce estimates at little computational cost. In certain embodiments, a Random Forest model may have several hyper-parameters that affect the performance of the model. The hyper-parameters may be tuned online or offline using historical data for optimal accuracy. As drilling continues and new training data is appended to the training set M, the training process above may be repeated.

Figure 3:
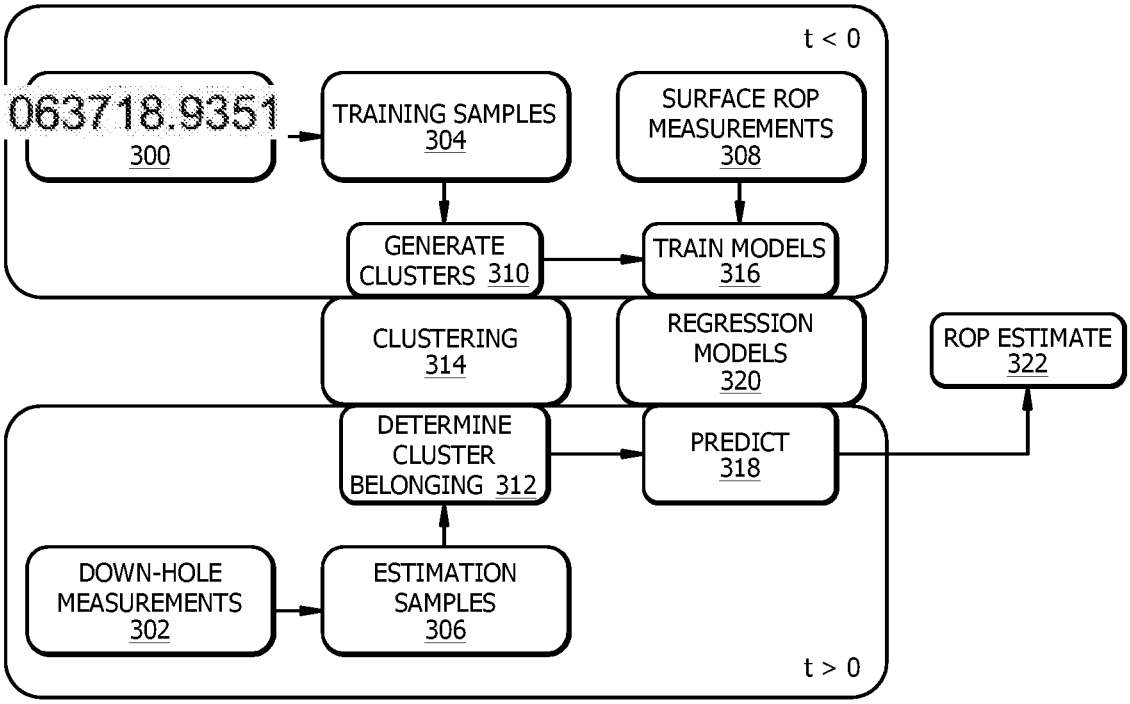
FIG. 3 is a process diagram illustrating an example of a process for estimating downhole ROP that may be used in accordance with certain embodiments of the present disclosure.

FIG. 3 is a process diagram illustrating an example of a process for estimating downhole ROP that may be used in accordance with one or more embodiments of the present disclosure. In certain embodiments, the downhole measurements 300 may be used to produce training samples 304. In certain embodiments, the downhole measurements 302 may be used to estimate ROP, thereby producing estimation samples 306. In certain embodiments, once the samples are prepared, clustering 314 may be performed. The training samples 304 may be used to generate clusters 310. The estimation samples 306 may then be used to determine cluster belonging 312. In certain embodiments, predictions 318 may be fed into one or more regression models 320. The generated clusters 310 and surface ROP measurements 308 may be used to train the models 316. Finally, predictions 318 trained by the one or more regression models 320 may be used to produce ROP estimates 322. The data labels "t<0" and "t>0" in FIG. 3 delineate the order of events surrounding a given point in time t.

Once the Random Forest models are trained (in other words, at t=0), the full model may be used to estimate the drill bit's ROP 322. In one or more embodiments, the estimation process may consist of the following steps: (1) measurements may be acquired 302 and the features of the model $v_i$ 306 may be computed; (2) the augmented feature vector $v_i'$ may be created; (3) the augmented feature vector may be input to a k-means model 314 to determine cluster belonging 312, and the corresponding Random Forest model 320 may be selected; and (4) the feature vector $v_i$ 306 may be input to the Random Forest model 320 to determine an estimate of instantaneous ROP 322. In certain embodiments, the estimated ROP 322 may be used in control algorithms to improve downhole directional control.

Though the embodiments discussed in detail above utilize k-means and Random Forest algorithms, all suitable models fall within the scope of the present disclosure. Furthermore, it is within the ability of one skilled in the art and with the benefit of the present disclosure to choose a suitable model. For example and without limitation, one skilled in the art could select one or more of k-means algorithms, Random Forest algorithms, artificial neural networks, support vector machines, or any other suitable model. In certain embodiments, a data-driven regression model may be used in isolation and may not include a clustering sub-model. In certain embodiments, a similar model architecture to the downhole model architecture may be duplicated for use on the surface to monitor the accuracy of the downhole model. Surface embodiments may involve any necessary substitution of input variables that differ between surface and downhole; for example and without limitation, one skilled in the art may need to substitute weight on bit for downhole vibrations when constructing a surface-based model.

Figure 4:
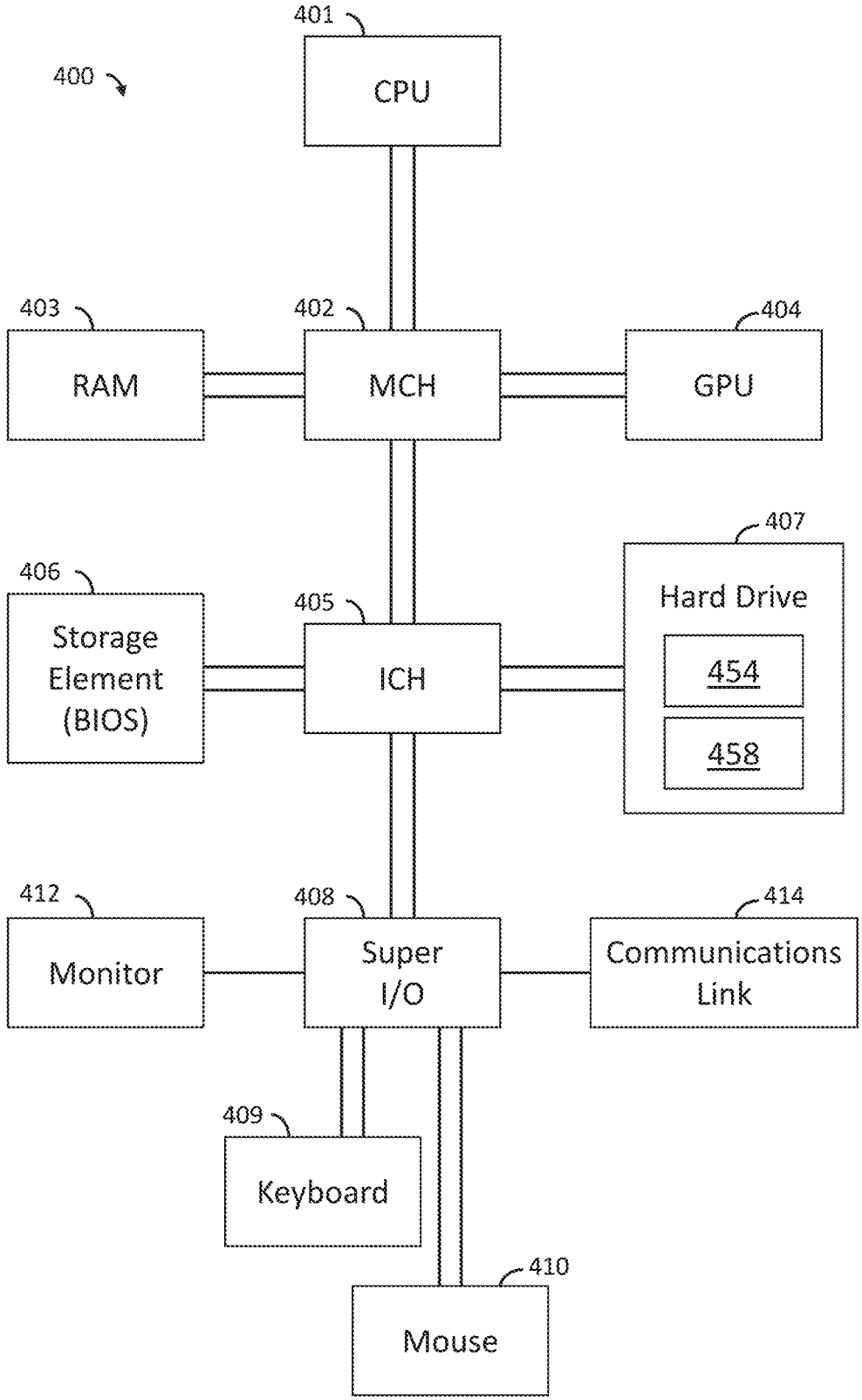
FIG. 4 is a schematic diagram illustrating an example of an information handling system that may be used in accordance with certain embodiments of the present disclosure.

FIG. 4 is a schematic diagram illustrating an example of an information handling system that may be used in accordance with certain embodiments of the present disclosure. A processor or central processing unit (CPU) 401 of the information handling system 400 is communicatively coupled to a memory controller hub (MCH) or north bridge 402. The processor 401 may include, for example, a microprocessor, microcontroller, digital signal processor (DSP), application specific integrated circuit (ASIC), or any other digital or analog circuitry configured to interpret and/or execute program instructions and/or process data. Processor 401 may be configured to interpret and/or execute program instructions or other data retrieved and stored in any memory such as hard drive 407. Program instructions or other data may constitute portions of a software or application, for example, application 458 or data 454, for carrying out one or more methods described herein. Memory may include read-only memory (ROM), random access memory (RAM), solid state memory, or disk-based memory. Each memory module may include any system, device, or apparatus configured to retain program instructions and/or data for a period of time (for example, non-transitory computer-readable media). For example, instructions from a software program or application 458 or data 454 may be retrieved and stored in memory for execution or use by processor 401. In one or more embodiments, the memory or the hard drive 407 may include or comprise one or more non-transitory executable instructions that, when executed by the processor 401, cause the processor 401 to perform or initiate one or more operations or steps. The information handling system 400 may be preprogrammed or it may be programmed (and reprogrammed) by loading a program from another source (for example, from a CD-ROM, from another computer device through a data network, or in another manner).

The data 454 may include BHA vibration data, BHA acceleration data, drill bit rotational velocity data, lithological data, or any other appropriate data. The one or more applications 458 may include one or more of k-means models, regression models, machine learning models, applications for down-sampling measured data, applications for calculating misfits, applications to minimize cost functions, applications to align measured data based on one or more of depth, resolution, or any other measurement, or any other appropriate applications. In one or more embodiments, a memory of a computing device may include additional or different data, application, models, or other information. In one or more embodiments, the data 454 may include one or more signals received by one or more sensors disposed upon a BHA.

The one or more applications 458 may comprise one or more software programs or applications, one or more scripts, one or more functions, one or more executables, or one or more other modules that are interpreted or executed by the processor 401. The one or more applications 458 may include machine-readable instructions for performing one or more of the operations related to any one or more embodiments of the present disclosure. The one or more applications 458 may include machine-readable instructions for generating a user interface or a plot. The one or more applications 458 may obtain input data, such as BHA vibration data, BHA acceleration data, drill bit rotational velocity data, lithological data, or any other appropriate data, from the memory 403, from another local source, or from one or more remote sources (for example, via the one or more communication links 414). The one or more applications 458 may generate output data and store the output data in the memory 403, hard drive 407, in another local medium, or in one or more remote devices (for example, by sending the output data via the communication link 414).

Modifications, additions, or omissions may be made to FIG. 4 without departing from the scope of the present disclosure. For example, FIG. 4 shows a particular configuration of components of information handling system 400. However, any suitable configurations of components may be used. For example, components of information handling system 400 may be implemented either as physical or logical components. Furthermore, in some embodiments, functionality associated with components of information handling system 400 may be implemented in special purpose circuits or components. In other embodiments, functionality associated with components of information handling system 400 may be implemented in configurable general-purpose circuit or components. For example, components of information handling system 400 may be implemented by configured computer program instructions.

Memory controller hub 402 may include a memory controller for directing information to or from various system memory components within the information handling system 400, such as memory, storage element 406, and hard drive 407. The memory controller hub 402 may be coupled to memory 403 and a graphics processing unit (GPU) 404. Memory controller hub 402 may also be coupled to an I/O controller hub (ICH) or south bridge 405. I/O controller hub 405 is coupled to storage elements of the information handling system 400, including a storage element 406, which may comprise a flash ROM that includes a basic input/output system (BIOS) of the computer system. I/O controller hub 405 is also coupled to the hard drive 407 of the information handling system 400. I/O controller hub 405 may also be coupled to an I/O chip or interface, for example, a Super I/O chip 408, which is itself coupled to several of the I/O ports of the computer system, including a keyboard 409, a mouse 410, a monitor 412 and one or more communications link 414. Any one or more input/output devices receive and transmit data in analog or digital form over one or more communication links 414 such as a serial link, a wireless link (for example, infrared, radio frequency, or others), a parallel link, or another type of link. The one or more communication links 414 may comprise any type of communication channel, connector, data communication network, or other link. For example, the one or more communication links 414 may comprise a wireless or a wired network, a Local Area Network (LAN), a Wide Area Network (WAN), a private network, a public network (such as the Internet), a Wi-Fi network, a network that includes a satellite link, or another type of data communication network.

A memory or storage device primarily stores one or more software applications or programs, which may also be described as program modules containing computer-executable instructions, which may be executed by the computing unit for implementing one or more embodiments of the present disclosure. The memory, therefore, may include one or more applications 458 including, for example, a transmitter control application 458, a receiver control application 458, and one or more applications 458 enabling one or more of the processes or sub-processes illustrated in FIGS. 1A, 1B, 2, and 3 or elsewhere in the present disclosure. The applications 458 may produce outputs, for example and without limitation, like those shown in FIG. 2. These applications 458 may integrate functionality from additional or third-party application programs or from system files stored in memory or on a storage device. System files, such as an ASCII text file, may be used to store the instructions, data input, or both for the applications as may be required in, for example, one or more steps of FIGS. 1A, 1B, 2, and 3 or elsewhere in the present disclosure. In certain embodiments, any one or more other applications 458 may be used in combination. In certain embodiments, any one or more other applications may be used in combination or may be used as stand-alone applications 458.

Although the computing device 400 is shown as having one or more generalized memories, the computing device 400 typically includes a variety of non-transitory computer readable media. By way of example, and not limitation, non-transitory computer readable media may comprise computer storage media and communication media. The memory may include computer storage media, such as a ROM and RAM in the form of volatile memory, nonvolatile memory, or both. A BIOS containing the basic routines that help to transfer information between elements within the computing unit, such as during start-up, is typically stored in the ROM. RAM typically contains data, program modules, other executable instructions, or any combination thereof that are immediately accessible to, presently being operated on, or both by the processing unit. By way of example, and not limitation, the computing device 400 may include an operating system, application programs 458, other program modules, and program data 454.

The components shown in the memory may also be included in other removable/non-removable, volatile/nonvolatile non-transitory computer storage media or the components may be implemented in the computing device 400 through an application program interface ("API") or cloud computing, which may reside on a separate computing device coupled through a computer system or network (not shown). For example and without limitation, a hard disk drive may read from or write to non-removable, nonvolatile magnetic media, a magnetic disk drive may read from or write to a removable, nonvolatile magnetic disk, and an optical disk drive may read from or write to a removable, nonvolatile optical disk such as a CD-ROM or other optical media. Other removable/non-removable, volatile/nonvolatile computer storage media that may be used in the exemplary operating environment may include, but are not limited to, magnetic tape cassettes, flash memory cards, digital versatile disks, digital video tape, solid state RAM, solid state ROM, or the like. The drives and their associated computer storage media discussed above provide storage of computer readable instructions, data structures, program modules, and other data for the computing unit.

The computing device 400 may receive commands or information from a user through one or more input devices such as the keyboard 409 and the mouse 410. Additional input devices may comprise a microphone, joystick, touchscreen, scanner, voice or gesture recognition, one or more sensors including one or more seismic sensors, and the like (not shown). These and other input devices may be coupled to the processing unit through the Super I/O chip 408 that is coupled to the ICH 405, but may be coupled by other interface and bus structures, such as a parallel port or a universal serial bus (USB) (not shown).

A monitor or other type of display device (not shown) may be coupled to the MCH 402 via an interface, such as the GPU 404 or via Super I/O chip 408. A graphical user interface ("GUI") may also be used with the video interface 404 to receive instructions from a user and transmit instructions to the central processing unit 401. A GUI may be used to display process outputs, including and without limitation the processes described in FIGS. 1A, 1B, 2, and 3 or elsewhere in the present disclosure, and may be used to prompt or display modification of subsurface operations or production activities. The computing device 400 may comprise peripheral output devices such as speakers, printer, external memory, any other device, or any combination thereof, which may be coupled through any output peripheral interface.

Any one or more input/output devices may receive and transmit data in analog or digital form over one or more communication links 414 such as a serial link, a wireless link (for example, infrared, radio frequency, or others), a parallel link, or another type of link. The one or more communication links 414 may comprise any type of communication channel, connector, data communication network, or other link. For example, the one or more communication links 414 may comprise a wireless or a wired network, a Local Area Network (LAN), a Wide Area Network (WAN), a private network, a public network (such as the Internet), a wireless fidelity or WiFi network, a network that includes a satellite link, or another type of data communication network.

Although many other internal components of the computing device 400 are not shown, those of ordinary skill in the art will appreciate that such components and their interconnection are well known.

Any one or more embodiments of the present disclosure may be implemented through a computer-executable program of instructions, such as program modules, generally referred to as software applications or application programs executed by a computer. A software application may include, for example, routines, programs, objects, components, data structures, any other executable instructions, or any combination thereof, that perform particular tasks or implement particular abstract data types. The software application forms an interface to allow a computer to react according to a source of input. For example, an interface application may be used to implement any one or more embodiments of the present disclosure. The software application may also cooperate with other applications or code segments to initiate a variety of tasks based, at least in part, on data received, a source of data, or any combination thereof. Other applications or code segments may provide optimization components including, but not limited to, neural networks, earth modeling, history-matching, optimization, visualization, data management, and economics. The software application may be stored, carried, or both on any variety of memory such as CD-ROM, magnetic disk, optical disk, bubble memory, and semiconductor memory (for example, various types of RAM or ROM). Furthermore, the software application and one or more inputs or outputs may be transmitted over a variety of carrier media including, but not limited to wireless, wired, optical fiber, metallic wire, telemetry, any one or more networks (such as the Internet), or any combination thereof.

Moreover, those skilled in the art will appreciate that one or more of the embodiments may comprise a variety of computer-system configurations, including hand-held devices, multiprocessor systems, microprocessor-based or programmable consumer electronics, minicomputers, mainframe computers, and any combination thereof Δny number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may, therefore, be implemented in connection with various hardware, software, or any combination thereof, in a computer system, information handling system, or other processing system.

An embodiment of the present disclosure is a method of estimating one or more downhole qualities of a drilling apparatus comprising: obtaining axial acceleration data by measuring an axial acceleration of a bottom hole assembly; and using the axial acceleration data to estimate a first one or more downhole qualities of the drilling apparatus, the first one or more downhole qualities comprising one or more of a first downward weight on a drill bit of the drilling apparatus or a first rate of penetration of the drill bit.

In certain embodiments discussed in the preceding paragraph, the axial acceleration may be measured using one or more single source sensors. In certain of the preceding embodiments, the axial acceleration may be measured via one or more direct measurements of axial acceleration or one or more indirect measurements of axial acceleration. In certain of the preceding embodiments, the one or more indirect measurements of axial acceleration may be acquired by estimating, calculating, or measuring axial acceleration based at least in part on data representing one or more vibrations of the bottom hole assembly. In certain of the preceding embodiments, an excitation frequency of the bottom hole assembly's axial vibrations may be estimated, calculated, or measured based at least in part on a frequency of the bottom hole assembly's stick slip vibrations. In certain of the preceding embodiments, one or more additional inputs may be acquired, the one or more additional inputs comprising one or more of a rotational velocity of the drill bit, a position of the drill bit, an angle of inclination of the drill bit, an azimuth of the drill bit, a flow rate, one or more formation indicators, a mass of the bottom hole assembly, a mass of a drill pipe system, a cumulative length of a drill pipe, a speed of sound in the drill pipe, or a stick-slip index. In certain of the preceding embodiments, the first one or more downhole qualities may be estimated by using the axial acceleration data in conjunction with the one or more additional inputs. In certain of the preceding embodiments, the first rate of penetration of the drill bit may be used to improve directional control of the bottom hole assembly. In certain of the preceding embodiments, training data may be acquired at least in part by measuring from a surface a second one or more downhole qualities, the second one or more downhole qualities comprising one or more of a second downward weight on the drill bit or a second rate of penetration of the drill bit. In certain of the preceding embodiments, the training data may be used to train an artificial intelligence model to estimate a third one or more downhole qualities, the third one or more downhole qualities comprising one or more of a third downward weight on the drill bit or a third rate of penetration of the drill bit. In certain of the preceding embodiments, the training data may be acquired at one or more regular intervals of distance or time.

Another embodiment of the present disclosure is a system for estimating one or more downhole qualities of a drilling apparatus, the system comprising: a bottom hole assembly; one or more downhole sensors disposed upon the bottom hole assembly; at least one drill bit disposed upon the bottom hole assembly; and an information handling system in electronic communication with the one or more downhole sensors, the information handling system comprising a processor and a non-transitory computer readable medium for storing one or more instructions that, when executed, causes the processor to: obtain axial acceleration data by measuring, via the one or more downhole sensors, an axial acceleration of the bottom hole assembly; and use the axial acceleration data to estimate a first one or more downhole qualities of the drilling apparatus, the first one or more downhole qualities comprising one or more of a first downward weight on the drill bit or a first rate of penetration of the drill bit.

In certain embodiments discussed in the preceding paragraph, the one or more downhole sensors may be single source sensors. In certain of the preceding embodiments, the axial acceleration may be measured via one or more direct measurements of axial acceleration or one or more indirect measurements of axial acceleration. In certain of the preceding embodiments, the one or more indirect measurements of axial acceleration may be acquired by estimating, calculating, or measuring axial acceleration based at least in part on data representing one or more vibrations of the bottom hole assembly. In certain of the preceding embodiments, an excitation frequency of the bottom hole assembly's axial vibrations may be estimated, calculated, or measured based at least in part on a frequency of the bottom hole assembly's stick slip vibrations. In certain of the preceding embodiments, one or more additional inputs may be acquired, the one or more additional inputs comprising one or more of a rotational velocity of the drill bit, a position of the drill bit, an angle of inclination of the drill bit, an azimuth of the drill bit, a flow rate, one or more formation indicators, a mass of the bottom hole assembly, a mass of a drill pipe system, a cumulative length of a drill pipe, a speed of sound in the drill pipe, or a stick-slip index. In certain of the preceding embodiments, the first one or more downhole qualities may be estimated by using the axial acceleration data in conjunction with the one or more additional inputs. In certain of the preceding embodiments, the first rate of penetration of the drill bit may be used to improve directional control of the bottom hole assembly. In certain of the preceding embodiments, training data may be acquired at least in part by measuring from a surface a second one or more downhole qualities, the second one or more downhole qualities comprising one or more of a second downward weight on the drill bit or a second rate of penetration of the drill bit. In certain of the preceding embodiments, the training data may be used to train an artificial intelligence model to estimate a third one or more downhole qualities, the third one or more downhole qualities comprising one or more of a third downward weight on the drill bit or a third rate of penetration of the drill bit. In certain of the preceding embodiments, The system of claim 21, the training data may be reacquired at one or more regular intervals of distance or time.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure.

In particular, every range of values (e.g., "from about a to about b," or, equivalently, "from approximately a to b," or, equivalently, "from approximately a-b") disclosed herein is to be understood as referring to the power set (the set of all subsets) of the respective range of values. The term "coupled" should be understood to include any connection between two things, including and without limitation a physical connection (including and without limitation a wired or mechanical connection), a non-physical connection (including and without limitation a wireless connection), or any combination thereof. The term "measure" and any derivative terms (including and without limitation "measures," "measured," and "measuring") disclosed herein is to be understood to mean one or more of directly quantifying data or indirectly quantifying data (including and without limitation indirect measurement of an output by differentiating or integrating an input). The expression "one or more of" followed by a collection of elements (for example and without limitation, "one or more of A and B") disclosed herein is to be understood as disjunctive (for example and without limitation, "one or more of A and B" could be satisfied by only A, only B, or both A and B); thus, as used herein, the meanings of "one or more of A and B" and "one or more of A or B" are identical. To disclose a conjunctive combination of two disjunctive sets, the phrase "one or more of A and one or more of B" may be used herein. Additionally, the words "comprising" (and any form of comprising, such as "comprise" and "comprises"), "having" (and any form of having, such as "has" and "have"), "including" (and any form of including, such as "includes" and "include") or "containing" (and any form of containing, such as "contains" and "contain") are to be understood as inclusive or open-ended and do not exclude additional, unrecited elements or method steps. The terms in the claims have their plain, ordinary meaning unless otherwise explicitly and clearly defined by the patentee.

What is claimed is:

1. A method of estimating one or more downhole qualities of a drilling apparatus, the method comprising:

obtaining axial acceleration data downhole by measuring an axial acceleration of a bottom hole assembly;

using the downhole axial acceleration data to estimate a first one or more downhole qualities of the drilling apparatus, the first one or more downhole qualities comprising one or more of:

a first downward weight on a drill bit of the drilling apparatus; or a first rate of penetration of the drill bit;

acquiring training data at least in part by measuring from a surface a second one or more downhole qualities, the second one or more downhole qualities comprising one or more of:

a second downward weight on the drill bit; or a second rate of penetration of the drill bit; and using the training data to train an artificial intelligence model to estimate a third one or more downhole qualities, the third one or more downhole qualities comprising one or more of:

a third downward weight on the drill bit; or a third rate of penetration of the drill bit.

2. The method of claim 1, wherein the axial acceleration is measured using one or more single source sensors.

3. The method of claim 1, wherein the axial acceleration is measured via one or more direct measurements of axial acceleration or one or more indirect measurements of axial acceleration.

4. The method of claim 3, wherein the one or more indirect measurements of axial acceleration are acquired by estimating, calculating, or measuring axial acceleration based at least in part on data representing one or more vibrations of the bottom hole assembly.

5. The method of claim 4, wherein an excitation frequency of the bottom hole assembly's axial vibrations is estimated, calculated, or measured based at least in part on a frequency of the bottom hole assembly's stick slip vibrations.

6. The method of claim 1, further comprising acquiring one or more additional inputs, the one or more additional inputs comprising one or more of a rotational velocity of the drill bit, a position of the drill bit, an angle of inclination of the drill bit, an azimuth of the drill bit, a flow rate, one or more formation indicators, a mass of the bottom hole assembly, a mass of a drill pipe system, a cumulative length of a drill pipe, a speed of sound in the drill pipe, or a stick-slip index.

7. The method of claim 6, wherein estimating the first one or more downhole qualities is performed by using the axial acceleration data in conjunction with the one or more additional inputs.

8. The method of claim 1, further comprising using the first rate of penetration of the drill bit to improve directional control of the bottom hole assembly.

9. A system for estimating one or more downhole qualities of a drilling apparatus, the system comprising:

a bottom hole assembly;

one or more downhole sensors disposed upon the bottom hole assembly;

at least one drill bit disposed upon the bottom hole assembly; and an information handling system in electronic communication with the one or more downhole sensors, the information handling system comprising:

a processor, and a non-transitory computer readable medium for storing one or more instructions that, when executed, causes the processor to:

obtain axial acceleration data downhole by measuring, via the one or more downhole sensors, an axial acceleration of the bottom hole assembly; and use the downhole axial acceleration data to estimate a first one or more downhole qualities of the drilling apparatus, the first one or more downhole qualities comprising one or more of:

a first downward weight on the drill bit; or a first rate of penetration of the drill bit;

acquire training data at least in part by measuring from a surface a second one or more downhole qualities, the second one or more downhole qualities comprising one or more of:

a second downward weight on the drill bit; or a second rate of penetration of the drill bit; and use the training data to train an artificial intelligence model to estimate a third one or more downhole qualities, the third one or more downhole qualities comprising one or more of:

a third downward weight on the drill bit; or a third rate of penetration of the drill bit.

10. The system of claim 9, wherein the one or more downhole sensors are single source sensors.

11. The system of claim 9, wherein the axial acceleration is measured via one or more direct measurements of axial acceleration or one or more indirect measurements of axial acceleration.

12. The system of claim 11, wherein the one or more indirect measurements of axial acceleration are acquired by estimating, calculating, or measuring axial acceleration based at least in part on data representing one or more vibrations of the bottom hole assembly.

13. The system of claim 12, wherein an excitation frequency of the bottom hole assembly's axial vibrations is estimated, calculated, or measured based at least in part on a frequency of the bottom hole assembly's stick slip vibrations.

14. The system of claim 9, further comprising acquiring one or more additional inputs, the one or more additional inputs comprising one or more of a rotational velocity of the drill bit, a position of the drill bit, an angle of inclination of the drill bit, an azimuth of the drill bit, a flow rate, one or more formation indicators, a mass of the bottom hole assembly, a mass of a drill pipe system, a cumulative length of a drill pipe, a speed of sound in the drill pipe, or a stick-slip index.

15. The system of claim 14, wherein estimating the first one or more downhole qualities is performed by using the axial acceleration data in conjunction with the one or more additional inputs.

16. The system of claim 9, further comprising using the first rate of penetration of the drill bit to improve directional control of the bottom hole assembly.

* * * * *